US008055009B2

(12) United States Patent
Porter

(10) Patent No.: US 8,055,009 B2
(45) Date of Patent: Nov. 8, 2011

(54) MOUNTABLE AUDIO SYSTEM FOR ELECTRONIC DEVICES

(76) Inventor: Anthony Porter, New Orleans, LA (US)

( * ) Notice: Subject to any disclaimer, the term of this patent is extended or adjusted under 35 U.S.C. 154(b) by 838 days.

(21) Appl. No.: 12/126,660

(22) Filed: May 23, 2008

(65) Prior Publication Data

US 2009/0290747 A1 Nov. 26, 2009

(51) Int. Cl.
*H04R 1/02* (2006.01)

(52) U.S. Cl. ..... 381/388; 248/918

(58) Field of Classification Search ..... 381/388, 381/386, 333, 306; 248/918
See application file for complete search history.

(56) References Cited

U.S. PATENT DOCUMENTS 5,947,434 A * 9/1999 Kosmoski et al. ..... 248/298.1
6,527,237 B2 * 3/2003 Harary et al. ..... 248/221.11
6,721,434 B2 * 4/2004 Polk et al. ..... 381/388
7,140,584 B2 * 11/2006 Bourque et al. ..... 248/274.1

* cited by examiner

*Primary Examiner* — Mark Prenty
(74) *Attorney, Agent, or Firm* — Michael Ries

(57) ABSTRACT

Disclosed is a mountable audio system configured to be mounted on an electronic device, such as a computer monitor, a television and a music system. The mountable audio system includes a frame assembly, a pair of audio sources and a fastening mechanism. The frame assembly includes a pair of frame members. Each frame member of the pair of frame members includes a first portion and a second portion coupled to the first portion. The pair of frame members is removably coupled to each other by slidably engaging and disengaging first portions of the pair of frame members. The pair of audio sources is coupled to second portions of the pair of frame members. The fastening mechanism is capable of detachably coupling the frame assembly and the pair of audio sources with the electronic device.

5 Claims, 2 Drawing Sheets

MOUNTABLE AUDIO SYSTEM FOR ELECTRONIC DEVICES

FIELD OF THE INVENTION

The present invention relates generally to audio systems, and, more particularly, to a mountable audio system which may be conveniently mounted on an electronic device, such as a computer monitor, a television and a music system.

BACKGROUND OF THE INVENTION

Use of electronic devices for entertainment and work purposes is an integral part of our daily life. Such electronic devices may include, but are not limited to, a television, a computer and a music system. Most of such electronic devices include externally connected speakers to produce a quality sound. These speakers are connected to the electronic devices by wires.

Although the use of externally connected speakers provide a liberty to a user to position the speakers at desired place, there are few issues associated with the use of such externally connected speakers. Particularly, when in use, the externally connected speakers requires a socket for plugging, a location for placing the speakers, and wires that are subject to tangling, all of which is inconvenient and causes discomfort for the user.

Accordingly, there exists a need for a mountable audio system which may be conveniently mounted on an electronic device, thereby enabling a user to avoid a clutter caused by use of externally connected speakers.

SUMMARY OF THE INVENTION

In view of the foregoing disadvantages inherent in the prior art, the general purpose of the present invention is to provide a mountable audio system configured to include all the advantages of the prior art, and to overcome the drawbacks inherent therein.

Accordingly, an object of the present invention is to provide a mountable audio system which may be conveniently mounted on an electronic device, such as a computer monitor, a television and a music system.

Another object of the present invention to provide a mountable audio system which may be configured to be mounted on a plurality of electronic devices having different sizes.

In light of the above objects, in one aspect of the present invention, a mountable audio system for an electronic device is disclosed. The mountable audio system includes a frame assembly, a pair of audio sources and a fastening mechanism. The frame assembly includes a pair of frame members. Each frame member of the pair of frame members includes a first portion and a second portion. The pair of frame members is removably coupled to each other by slidably engaging and disengaging first portions of the pair of frame members. The pair of audio sources is coupled to second portions of the pair of frame members. The fastening mechanism is capable of detachably coupling the frame assembly and the pair of audio source with the electronic device.

These together with other aspects of the present invention, along with the various features of novelty that characterize the present invention, are pointed out with particularity in the claims annexed hereto and form a part of this present invention. For a better understanding of the present invention, its operating advantages, and the specific objects attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawing, in which:

Like reference numerals refer to like parts throughout the description of several views of the drawings.

DETAILED DESCRIPTION OF THE INVENTION

The exemplary embodiments described herein detail for illustrative purposes are subject to many variations in structure and design. It should be emphasized, however, that the present invention is not limited to a mountable audio system, as shown and described. It is understood that various omissions and substitutions of equivalents are contemplated as circumstances may suggest or render expedient, but these are intended to cover the application or implementation without departing from the spirit or scope of the claims of the present invention.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

The present invention provides a mountable audio system for an electronic device, such as a television, a computer monitor and a music system. The mountable audio system is capable of being conveniently mounted on such electronic devices.

Figure 1:
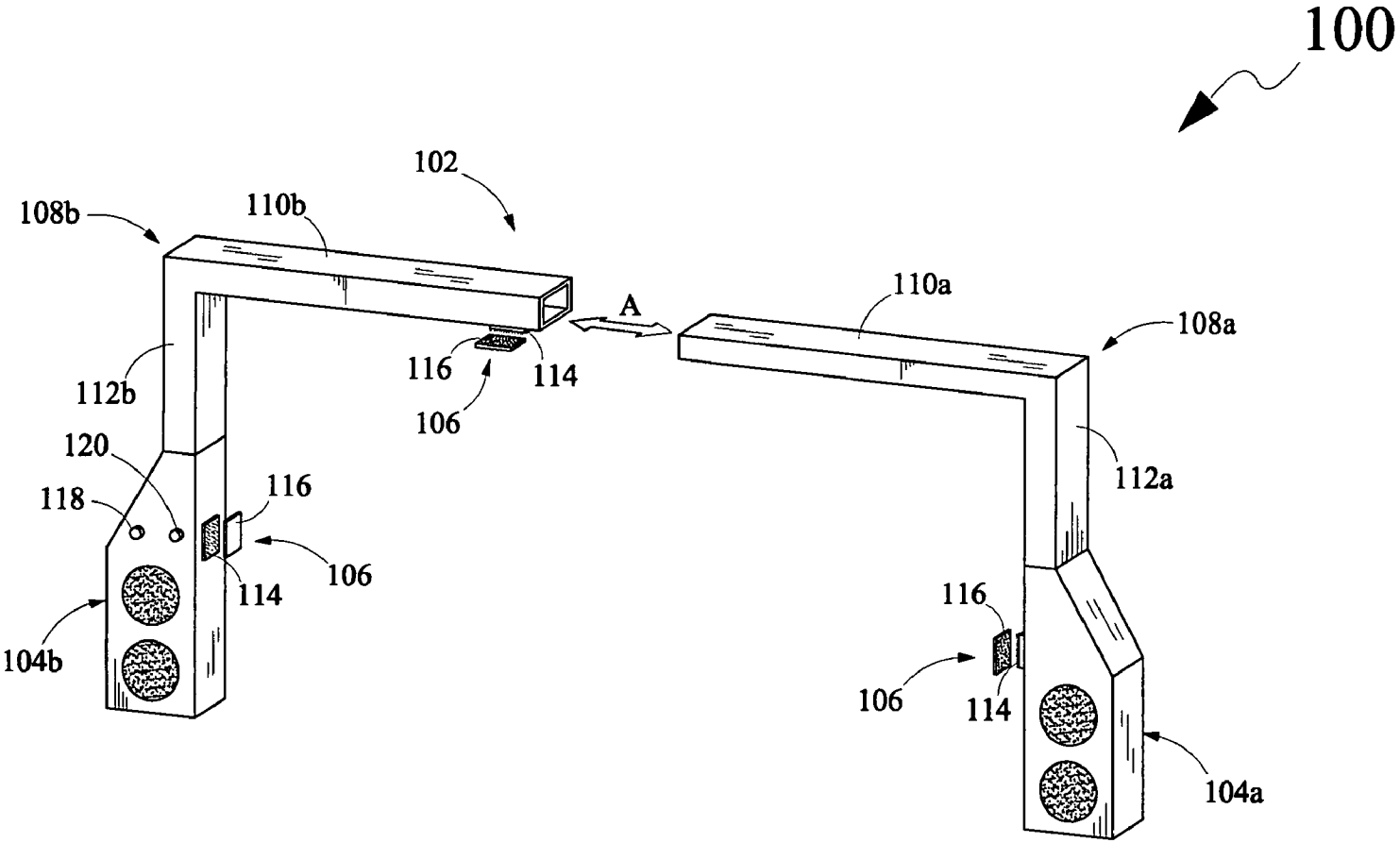
FIG. 1 illustrates a perspective view of a mountable audio system, in accordance with an embodiment of the present invention.

Referring to FIG. 1, illustrated is a perspective view of a mountable audio system 100, in accordance with an embodiment of the present invention. The mountable audio system 100 includes a frame assembly 102, a pair of audio sources, such as an audio source 104*a* and an audio source 104*b* (hereinafter collectively referred to as pair of audio sources 104), and a fastening mechanism 106.

The frame assembly 102 includes a pair of frame members, such as a frame member 108*a* and a frame member 108*b*. Hereinafter, the frame members 108*a* and 108*b* are collectively referred to as pair of frame members 108. Each frame member of the pair of frame members 108 includes a first portion and a second portion coupled to the first portion. More specifically, the frame member 108*a* includes a first portion 110*a* and a second portion 112*a*, where the second portion 112*a* is coupled to the first portion 110*a*. Similarly, the frame member 108*b* includes a first portion 110*b* and a second portion 112*b*, where the second portion 112*b* is coupled to the first portion 110*b*.

In the present embodiment, the pair of frame members 108 is configured to have a hollow rectangular cross-section for the purpose of illustration. However, it will be obvious to a person skilled in the art that the pair of frame members 108 may be configured to have any other cross-section apart from the hollow rectangular cross-section, such as hollow circular cross-section, hollow elliptical cross-section and a hollow polygonal cross-section. Further, in the embodiment of the present invention shown in FIG. 1, the first portions 110*a* and 110*b* and the second portions 112*a* and 112*b* of the pair of frame members 108 are coupled to configured L-shaped structures, and it should not be considered as limiting the scope of the present invention.

The pair of frame members 108 is removably coupled to each other. In one embodiment of the present invention, the removable coupling between the pair of frame members 108 is enabled by slidably engaging and disengaging the pair of frame members 108. More specifically, the first portion 110*a* is configured to be slidably engaged and disengaged with the first portion 110*b*. The first portion 110*a* may be inserted into the first portion 110*b* and may be thereafter withdrawn from the first portion 110*b*, as depicted by an arrow A, for enabling the removable coupling of the first portion 110*a* to the first portion 110*b*. However, it will be obvious to a person skilled in the art that the slidable coupling between the first portions 110*a* and 110*b* may be configured by other mechanism, such as the first portion 110*b* may be configured with a channel capable of receiving the first portion 110*a* therein and the like.

Figure 2:
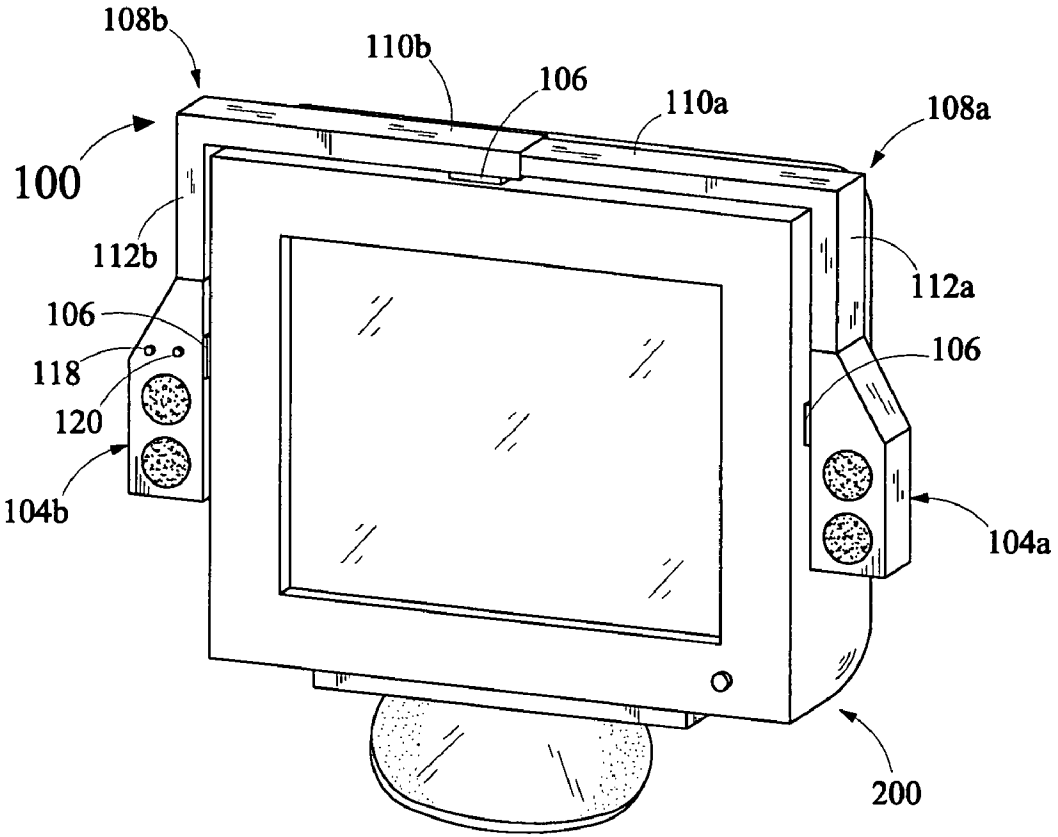
FIG. 2 is a perspective view illustrating an application of the mountable audio system, in accordance with an embodiment of the present invention.

The pair of audio sources 104 is coupled to second portions of the pair of frame members 108. More specifically, the audio source 104*a* is coupled to the second portion 112*a* of the frame member 108*a* and the audio source 104*b* is coupled to the second portion 112*b* of the frame member 108*b*. The term 'audio source' used herein refers to a speaker which is capable of converting an electrical signal into sound. The pair of audio sources 104 and the frame assembly 102 may be detachably coupled with an electronic device by the fastening mechanism 106. The coupling of the audio sources 104 and the frame assembly 102 with the electronic device is shown in FIG. 2.

In one embodiment of the present invention, the fastening mechanism 106 includes at least one hook and loop fastener. In FIG. 1, a hook and loop fastener is represented by a hook portion 114 and a loop portion 116. However, it will be evident to person skilled in the art that the fastening mechanism 106 may be any other mechanism apart from hook and loop fasteners, such as an adhesive patch, and the like.

Without limiting the scope of the present invention, in an embodiment, the fastening mechanism 106 is configured on the first portion 110*b* of the frame member 108*b* and the pair of audio sources 104, as shown in FIG. 1. However, it will be obvious to person skilled in the art that one of hook portions 114 or loop portions 116 are coupled with the pair of audio sources 104 and the first portion 110*b*. Further, remaining of the hook portion 114 or the loop portion 116 needs to be coupled with the electronic device for enabling the detachable coupling of the mountable audio system 100 on the electronic device. For example, the hook portions 114 may be coupled to the first portion 110*b* and the pair of audio sources 104 and the loop portions 116 may be coupled to the electronic device.

The pair of audio sources 104 is electrically coupled to the electronic device by the electrical wires (not shown). More specifically, the electrical wires enable the pair of audio sources 104 to receive electrical power from the electronic device or any external power source. The electrical wires further enables the pair of audio sources 104 to receive audio signals from the electronic device for generating sound. The pair of audio sources 104 may further include at least one switch for operating the pair of audio sources 104. In one embodiment of the present invention, the audio source 104*b* is configured with a switch 118 and a switch 120 for operating the pair of audio sources 104. Specifically, the switch 118 may be used for turning ON and OFF the pair of audio sources 104 and the switch 120 may be used for adjusting a volume of the sound generated by the pair of audio sources 104.

Referring to FIG. 2, illustrated is a perspective view of an application of the mountable audio system 100, in accordance with an embodiment of the present invention. The mountable audio system 100 is mounted on the electronic device, such as a computer monitor 200. However, it will be apparent to person skilled in the art that the electronic device may be a television, a music system, or any similar device. The mountable audio system 100 is mounted on the computer monitor 200 and coupled thereto by the fastening mechanism 106. More specifically, the first portions 110*a* and 110*b* are supported on a top peripheral portion of the computer monitor 200 and coupled thereto by the fastening mechanism 106 disposed between the first portion 110*b* and the top peripheral portion of the computer monitor 200. The second portions 112*a* and 112*b* and the pair of audio sources 104 are supported on side peripheral portions of the computer monitor 200 and coupled thereto by the fastening mechanism 106 disposed between the side peripheral portions and the pair of audio sources 104.

The mountable audio system 100 of the present invention may be configured to be mounted on a plurality of electronic devices having different sizes. More specifically, the first portion 110*a* of the frame member 108*a* may be inserted and withdrawn from the first portion 110*b* of the frame member 108*b* in a manner such that a distance between the pair of audio sources 104 may be adjusted. By adjusting the distance between the pair of audio sources 104, the mountable audio system 100 may be configured to be conveniently mounted on the plurality of electronic devices having different sizes. Further, the fastening mechanism 106 is coupled to support the mountable audio system 100 on the plurality of electronic devices.

A mountable audio system such as the mountable audio system 100, explained in conjunction with FIGS. 1 and 2, may be used for any electronic device having externally connected speakers. However, it will be obvious to a person skilled in the art that the electronic device should have a substantial peripheral area which is capable of supporting the mountable audio system thereon. The use of mountable audio system enables in avoiding a clutter created by use of externally connected speaker. More specifically, the use of mountable audio system eliminates a need for a socket for plugging the externally connected speaker, for a location for placing the externally connected speaker and for wires that are subject to getting tangled around due to the use of such an externally connected speaker. Further, the mountable audio system may be manufactured in a cost effective manner because of its simple design and components, which are used for configuring the mountable audio system. Furthermore, the mountable audio system may be configured with optional electrical wirings such that same mountable audio system may be used by a plurality of electronic devices, such as a computer monitor, a television and a music system.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, and to thereby enable others skilled in the art to best utilize the present invention and various embodiments with various modifications as are suited to the particular use contemplated. It is understood that various omissions and substitutions of equivalents are contemplated as circumstances may suggest or render expedient, but such omissions and substitutions are intended to cover the application or implementation without departing from the spirit or scope of the claims of the present invention.

What is claimed is:

1. A mountable audio system for an electronic device, the mountable audio system comprising:

a frame assembly, the frame assembly comprising a pair of frame members, each frame member of the pair of frame members having a first portion and a second portion, wherein the pair of frame members is removably coupled to each other by slidably engaging and disengaging first portions of the pair of frame members;

a pair of audio sources coupled to second portions of the pair of frame members; and a fastening mechanism capable of detachably coupling the frame assembly and the pair of audio sources with the electronic device.

2. The mountable audio system of claim 1 further comprising electrical wires for electrically coupling the pair of audio sources with the electronic device.

3. The mountable audio system of claim 1, wherein the electronic device is at least one of a computer monitor, a television and a music system.

4. The mountable audio system of claim 1, wherein the fastening mechanism is a hook and loop fastener.

5. The mountable audio system of claim 1, wherein the pair of audio sources comprises at least one switch for operating the pair of audio sources.

* * * * *